US007320443B2

(12) United States Patent
Nalini

(10) Patent No.: US 7,320,443 B2
(45) Date of Patent: Jan. 22, 2008

(54) AIRLESS ATOMIZING NOZZLE

(75) Inventor: Luigi Nalini, Padua (IT)

(73) Assignee: Carel S.p.A., Brugine (Padua) (IT)

( * ) Notice: Subject to any disclaimer, the term of this patent is extended or adjusted under 35 U.S.C. 154(b) by 378 days.

(21) Appl. No.: 10/625,842

(22) Filed: Jul. 24, 2003

(65) Prior Publication Data

US 2004/0144871 A1 Jul. 29, 2004

Related U.S. Application Data

(60) Provisional application No. 60/401,030, filed on Aug. 6, 2002.

(51) Int. Cl.
*B05B 1/00* (2006.01)

(52) U.S. Cl. ..... 239/596; 239/518; 239/507; 239/505; 239/512; 239/589; 239/DIG. 19

(58) Field of Classification Search ..... 239/518, 239/524, 512, 515, 513, 545, 505, 507, 600
See application file for complete search history.

(56) References Cited

U.S. PATENT DOCUMENTS

| | | | | | |
|---|---|---|---|---|---|
| 921,205 | A | | 5/1909 | Cramer | |
| 1,761,422 | A | * | 6/1930 | Wagner | 239/512 |
| 1,940,171 | A | | 12/1933 | Huss | |
| 2,009,932 | A | | 7/1935 | Klotzman | |
| 2,058,823 | A | | 10/1936 | Pigott | |
| 2,132,720 | A | | 10/1938 | Christensen, Jr. | |
| 2,410,215 | A | | 10/1946 | Houghton | |
| 2,451,071 | A | * | 10/1948 | Cline | 239/515 |
| 2,540,663 | A | * | 2/1951 | Garey | 239/462 |
| 2,701,165 | A | | 2/1955 | Bete et al. | |
| 2,778,685 | A | | 1/1957 | Umbricht | |
| 2,850,326 | A | | 9/1958 | Kofford | |
| 3,150,442 | A | | 9/1964 | Straw et al. | |
| 3,778,542 | A | | 12/1973 | Hanseman | |
| 3,788,542 | A | | 1/1974 | Mee | |
| 3,894,691 | A | | 7/1975 | Mee | |
| 4,011,996 | A | | 3/1977 | Tsuji et al. | |
| 4,150,794 | A | | 4/1979 | Higgins | |
| 4,244,521 | A | | 1/1981 | Guse | |
| 4,564,375 | A | * | 1/1986 | Munk et al. | 96/364 |
| 4,592,506 | A | | 6/1986 | Capes et al. | |
| 4,813,610 | A | | 3/1989 | Renowden | |
| 4,869,430 | A | | 9/1989 | Good | |
| 4,932,591 | A | | 6/1990 | Cruz | |

(Continued)

FOREIGN PATENT DOCUMENTS

| | | |
|---|---|---|
| BE | 540399 | 9/1954 |

(Continued)

*Primary Examiner*—Dinh Q. Nguyen
(74) *Attorney, Agent, or Firm*—Barley Snyder LLC

(57) ABSTRACT

An airless atomizing nozzle comprises a tubular body including a bore having an inlet and an outlet; a cylindrical member including a face and a cylindrical delivery channel secured at the outlet, the delivery channel having substantially uniform diameter; and a pin including a target area spaced from and directly over the delivery channel outlet. The delivery channel includes a tapered inlet and an outlet terminating at the face. A method for aligning a target on a pin over an orifice in an airless atomizing nozzle body is also disclosed.

15 Claims, 4 Drawing Sheets

U.S. PATENT DOCUMENTS

| | | | | | |
|---|---|---|---|---|---|
| 5,033,681 | A | | 7/1991 | Munoz | |
| 5,075,968 | A | | 12/1991 | Stalder et al. | |
| 5,299,346 | A | | 4/1994 | Kilgore et al. | |
| 5,563,643 | A | * | 10/1996 | Carlotta et al. | 347/87 |
| 5,620,142 | A | | 4/1997 | Elkas | |
| 5,682,187 | A | * | 10/1997 | Watanabe et al. | 347/45 |
| 5,743,469 | A | | 4/1998 | Reintanz | |
| 5,893,520 | A | | 4/1999 | Elkas | |
| 6,142,391 | A | | 11/2000 | Seyed et al. | |
| 6,189,214 | B1 | | 2/2001 | Skeath et al. | |
| 6,722,588 | B1 | * | 4/2004 | Elkas | 239/596 |

FOREIGN PATENT DOCUMENTS

| | | |
|---|---|---|
| CH | 300480 | 8/1954 |
| CH | 322896 | 7/1957 |
| DE | 1006354 | 4/1957 |
| GB | 1333651 | 10/1973 |
| GB | 1376591 | 12/1974 |
| JP | 60-226611 | 11/1985 |

* cited by examiner

AIRLESS ATOMIZING NOZZLE

RELATED APPLICATIONS

This is a nonprovisional application claiming the priority benefit of provisional application Ser. No. 60/401,030 filed Aug. 6, 2002, hereby incorporated by reference.

FIELD OF THE INVENTION

The present invention relates generally to an airless atomizing nozzle and particularly to a fog nozzle used for humidification, misting, evaporative cooling and other applications.

BACKGROUND OF THE INVENTION

When water is discharged through an orifice under very high pressure (for example, 1000 psi) and then made to contact a target held in front, the water shatters into small droplets suitable for humidification, misting and other applications. For greater atomizing, the target has to be precisely aligned with the orifice. The orifice wall must be smooth to minimize turbulence in the water as it exists the orifice to produce a thin coherent stream of water directed at the target. The orifice also has to be abrasion resistant to maintain its smooth inner wall and minimize turbulence.

OBJECTS AND SUMMARY OF THE INVENTION

It is an object of the present invention to provide an airless atomizing nozzle that uses a smooth delivery channel with a lead-in conical inlet to minimize water turbulence.

It is another object of the present invention to provide a an airless atomizing nozzle using a target area positioned over the nozzle outlet using an adhesive.

It is another object of the present invention to provide an airless atomizing nozzle using an orifice member secured directly to the nozzle body without using a separate holder.

It is yet another object of the present invention to provide an airless atomizing nozzle with minimal number of components.

In summary, the present invention provides an airless atomizing nozzle, comprising a tubular body including a bore having an inlet and an outlet; a cylindrical member including a face and a cylindrical delivery channel secured at the outlet, the delivery channel having substantially uniform diameter; and a pin including a target area spaced from and directly over the delivery channel outlet. The delivery channel includes a tapered inlet and an outlet terminating at the face.

The present invention also provides an airless atomizing nozzle, comprising a tubular body including a bore having an inlet and an outlet; a member including a second face and an orifice secured at the outlet; and a pin including a target area spaced from and directly over the delivery channel outlet. The body includes a first face disposed at said outlet. The pin is secured to the body with UV curable adhesive.

The present invention further provides a method for aligning a target on a pin over an orifice in an airless atomizing nozzle body, comprising:

a) positioning the target over the orifice;

b) directing light through the orifice toward the target;

c) detecting light passing past the target;

d) re-positioning the target over the orifice until the light passing past the target substantially disappears; and e) securing the pin to the nozzle body.

These and other objects of the present invention will become apparent from the following detailed description.

BRIEF DESCRIPTIONS OF THE DRAWINGS

DETAILED DESCRIPTION OF THE INVENTION

Figure 1:
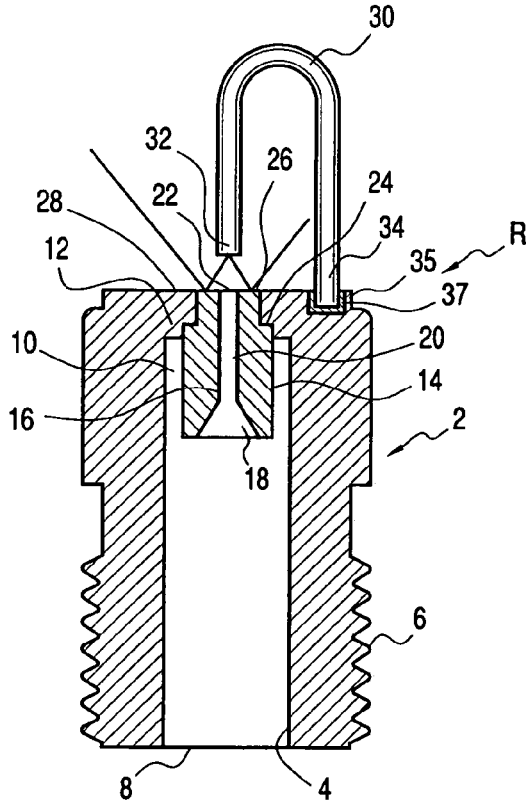
FIG. 1 is a cross-sectional view of an airless atomizing nozzle made in accordance with the present invention, showing the delivery channel member flush with the face of the nozzle body.

An airless atomizing nozzle R made in accordance with the present invention is disclosed in FIG. 1. The nozzle R comprises a tubular body 2 preferably made of stainless steel, including a cylindrical bore 4. Threads 6 or other conventional means are used to connect the nozzle R to a source of water to be atomized. The cylindrical bore 4 has an inlet end 8 and outlet end 10. The outlet end 10 narrows down to a smaller opening by means of a series of cylindrical steps that form radially inwardly projecting shoulders 12.

A cylindrical member 14 including a delivery channels 16 is disposed at the outlet end 10. The delivery channel 16 includes a conical inlet 18 that narrows smoothly into a cylindrical passageway 20 that terminates in an outlet 22. The member 14 has a reduced outer diameter at the outlet end, forming a shoulder 24 that engages a corresponding shoulder 12 on the body 2. The opposing shoulders 12 and 24 advantageously hold the member 14 in place against the water pressure within the bore 4. The member 14 is preferably made of borosilicate glass and is available from several manufacturers of micro glass capillaries (also known as ferrules) used in the fiber optic connector art. One example of the member 14 is a single-cone end capillary, known as a micro capillary, made by Nippon Electric Glass Co., Ltd. Borosilicate glass is advantageously very hard and abrasion resistant, chemically inert and has a very high temperature tolerance. Since the member 14 is used as a fiber support in optical devices, the inside surface of the delivery channel 16, including the conical inlet 18, is very smooth to prevent scratching an optic fiber inserted into the channel. The angle of the conical inlet 18 may be any angle. The member 14 is preferably pressed fit into the bore 4.

Figure 2:
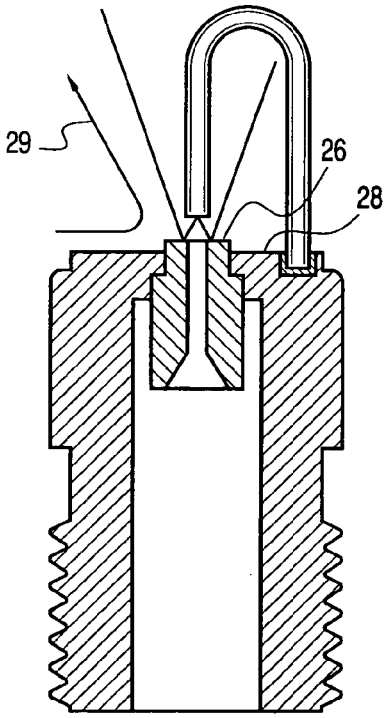
FIG. 2 is similar to FIG. 1, but showing the delivery channel member projecting above the face of the nozzle body.
Figure 3:
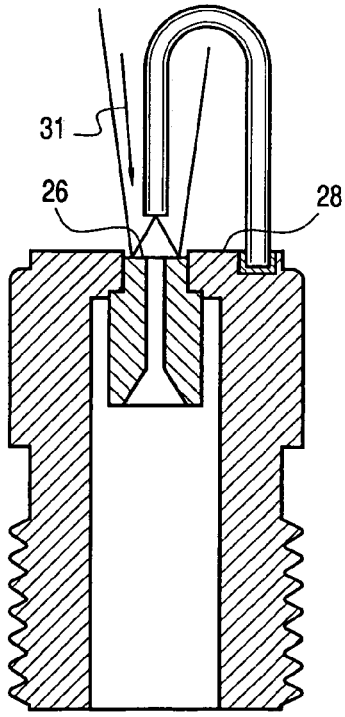
FIG. 3 is similar to FIG. 1, but showing the delivery channel member recessed with respect to the face of the nozzle.

The member 14 has a face 26 which is disposed flush with a face 28 of the body 2 in one embodiment of the invention. In another embodiment, shown in FIG. 2, the face 26 projects above the face 28. In yet another embodiment, as shown in FIG. 3, the face 26 is recessed with respect to the face 28. These various embodiments generally produce varying spray patterns, as will be discussed below. Directly securing the member 14 to the body 2 advantageously provides flexibility in positioning the member face 26 relative to the body face 28.

A pin 30, preferably U-shaped, has one end with a target area 32 disposed directly above the outlet 22 and another end 34 secured to the body 2 in a hole 35 with adhesive 37 or other standard means. In one aspect of the invention, the adhesive is preferably UV curable, as well be discussed below. The pin 30 is preferably made from stainless steel.

Target area 32 is substantially the same area as the cross-sectional area of the outlet 22. The distance between the outlet 22 and the target area 32 is standard and well known to the person skilled in the art. Generally, for a wider pattern, the target is set closer to the outlet; and for a narrower pattern, the target is set higher. The size of the target area and the outlet 22 are also well known to those skilled in the art.

The conical inlet 18 provides a lead-in into the delivery channel 16, providing for smooth flow of the water through the cylindrical passageway 20 with minimal turbulence. This results in the water exiting the outlet 22 as a coherent stream without any interfering splatter or turbulence that can enlarge the droplets and destroy the mist patterns. Straight flow results in superior atomization when the water hits the target area 32.

The different positions of the member 14 in the cylindrical bore 4 where the face 26 of the member 14 is flushed, recessed or above the face 28 of the body 2 are useful in controlling the atomizing mist pattern and the air induction for draft or vacuum. In some applications, it is desired to have the faces flushed so that no vacuum or air draft is created and the spray pattern can be controlled accordingly, such as by changing the distance between the target and the nozzle outlet. In other cases, it is desired to have the member face 26 projecting above the face 28 of the body 2 so that the atomized mist can induce an air draft, generally indicated at 29, that can allow for better mixing of the air with the mist and thus shorten evaporation distances. In yet some applications, it is desired to have the member face 26 recessed with respect to the body face 28 so that an air vacuum, generally indicated at 31, is generated. A double bounce of the water off the face 26 and the surface of the walls of the body 2 can create a different mist pattern which is advantageous under certain circumstances. For a wider pattern, the target is set closer to the outlet.

Precise positioning of the target area 32 over the outlet 22 is required for proper functioning of the nozzle R. The pin 32 may be positioned and placed manually using a pair of pliers and a microscope. Once the pin is positioned, the nozzle is tested using water. If an adjustment is necessary to reposition the target area, the pin is bent into the proper position. Since metal has a tendency to spring back when bent, the pin is bent beyond the proper position so that it springs back into the right position when released.

Figure 4:
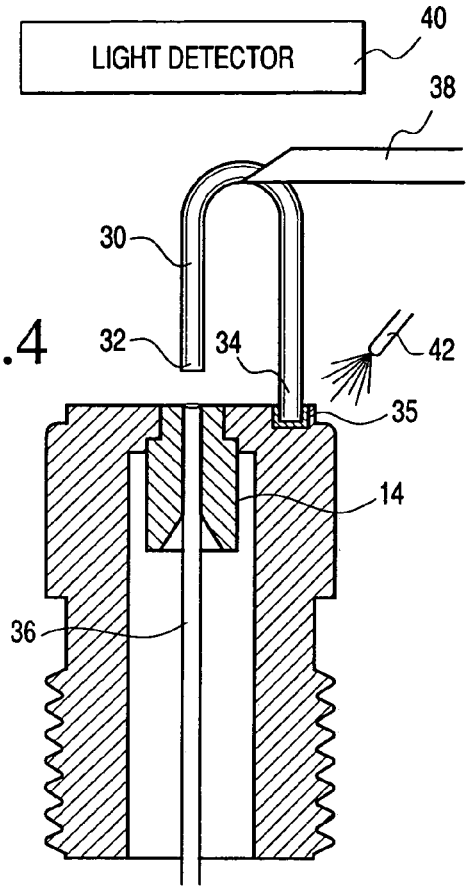
FIG. 4 is a schematic illustration of a method for positioning the target area over the nozzle outlet.
Figure 5A:
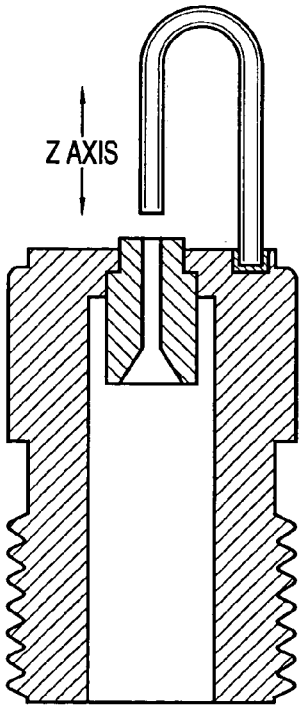
FIGS. 5A and 5B show the x, y and z positioning of the target area over the nozzle outlet.
Figure 5B:
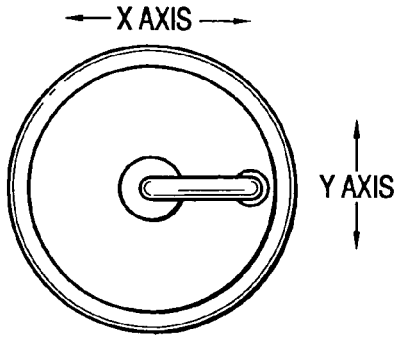
Figure 6:
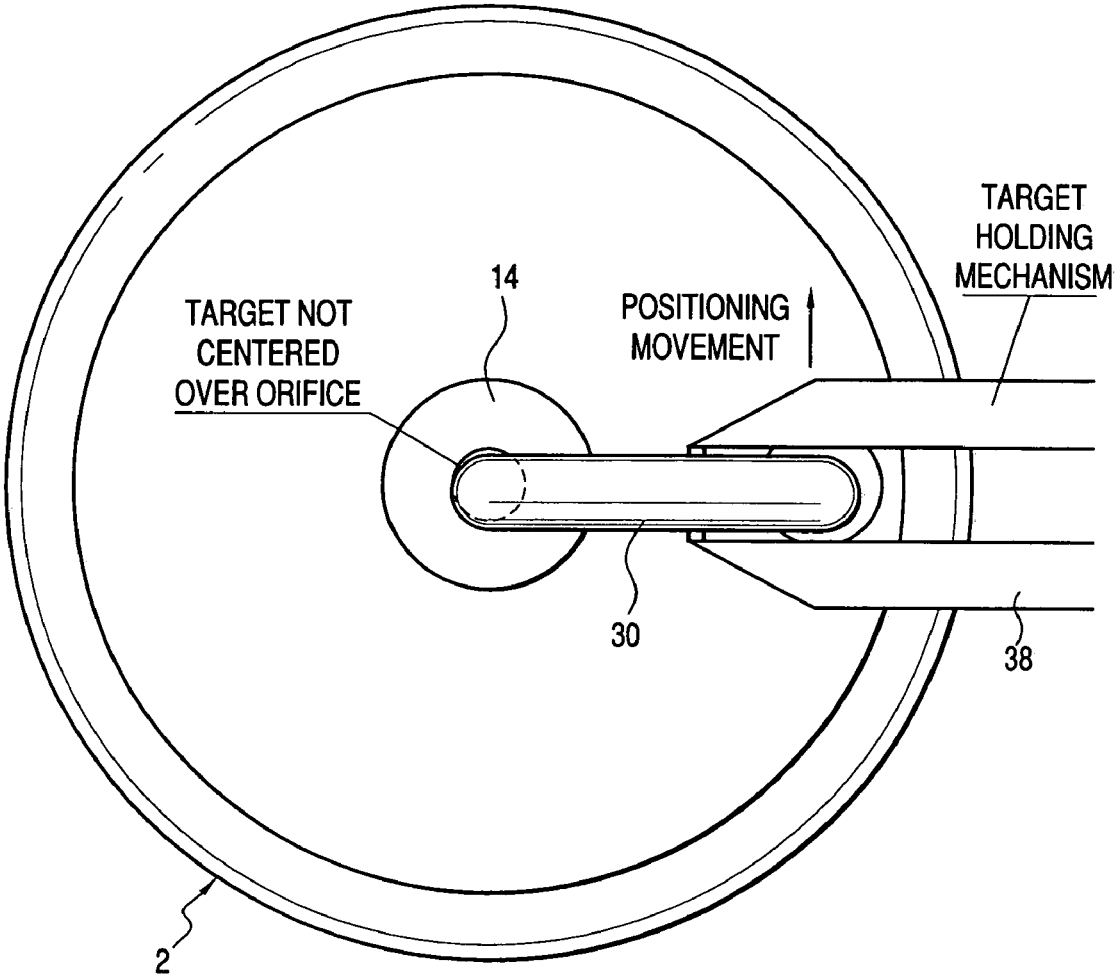
FIG. 6 shows the target area not precisely positioned over the outlet opening, thereby requiring appropriate adjustment so that the target area is completely over the nozzle outlet.

In an improvement to the above in accordance with the present invention, light is used to position the target area 32 precisely over the outlet 22. Referring to FIGS. 4, 5A and 5B, an optic fiber 36 is inserted through the member 14. A light source such as a laser (not shown) is connected to the optic fiber to shine at the target area 32. The pin 30 is held by a holding mechanism 38, such a robotic arm that has x, y and z degrees of movement. The end 34 of the pin is inserted into the hole 335 filled with a UV-curable adhesive. A light detector 40 is positioned above the target area 32 and is adapted to detect light not blocked by the target area 32. The holding mechanism 38 adjusts the target area 32 to a predetermined z axis distance above the outlet 22 and along the x and y axis until all the light from the optic fiber is substantially or completely blocked, as indicated by the light detector 40. Once positioned properly, a UV source 42, such as a UV lamp, is activated to cure the UV curable glue to secure the target area 32 in proper position. It should be understood by a person skilled in the art that the positioning of the target area 32 is automated by connecting the output of the light detector 40 to the controller of the holding mechanism 38 so that movement of the mechanism 38 is dictated by the level of light detected by the light detector 40. FIG. 6 shows the target area not centered over the outlet 22, thereby requiring adjustment to completely cover the outlet.

Instead of using the holding mechanism 38, the pin 32 can also be positioned manually with the use of the optic fiber 36 and the light detector 40.

Figure 7:
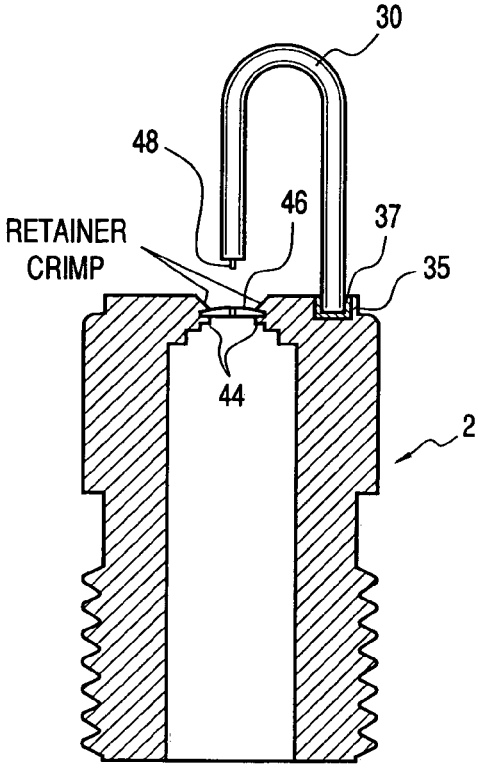
FIG. 7 is a cross-sectional view of another embodiment of the present invention, showing an orifice member secured to the nozzle body by crimping the nozzle body.
Figure 8A:
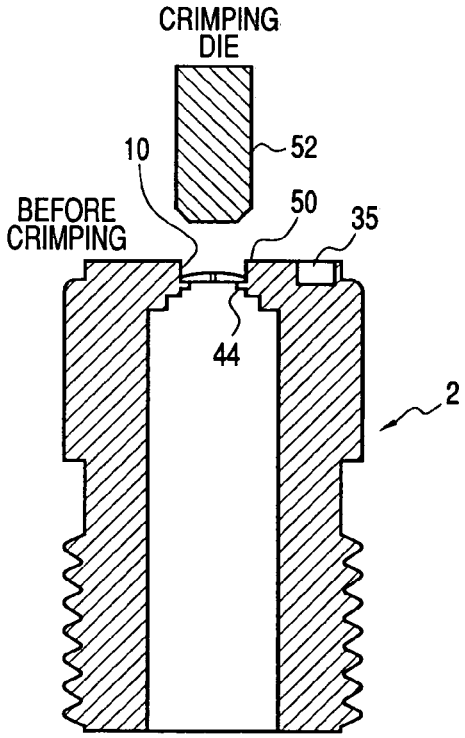
FIGS. 8A and 8B are cross-sectional views of the nozzle body showing the crimping step in securing the orifice member to the nozzle body.
Figure 8B:
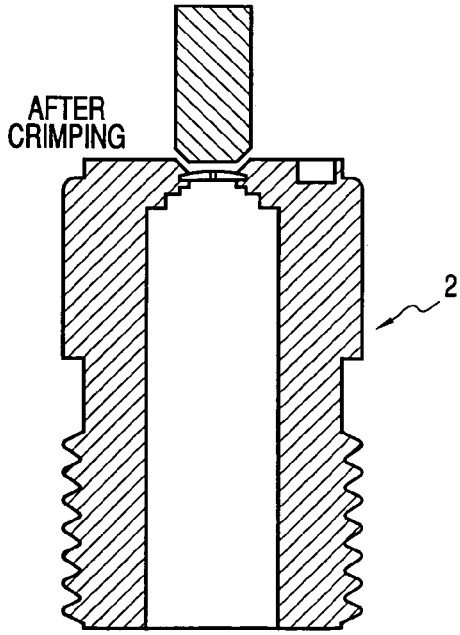

In another aspect of the present invention, the body 2 includes a lip 44 supporting an orifice member 46 with an orifice 48, as best shown in FIG. 7. The orifice member 46 is preferably made of ruby. The orifice member 46 is secured to the lip 44 by crimping the body portion 50 disposed above the member 46 with a crimping die 52, as best shown in FIGS. 8A and 8B. The metal around the outlet 10 is deformed and presses against the outer edge portion of the orifice member, thereby clamping the member 46 to the body 2. The orifice member 46 may also be secured to the body 2 with adhesive, preferably with UV curable.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. An airless atomizing nozzle, comprising:

a) a tubular body including a bore having an inlet and an outlet;

b) said body including a first face disposed at said outlet;

c) a cylindrical member including a second face and a cylindrical delivery channel secured at said outlet, said delivery channel having substantially uniform diameter;

d) said delivery channel including a tapered inlet at one end of said channel and an outlet at an opposite end of said channel terminating at said second face, said channel outlet having the same diameter as said delivery channel; and e) a pin including a target area spaced from and directly over said delivery channel outlet.

2. An airless atomizing nozzle as in claim 1, wherein said second face is flush with said first face.

3. An airless atomizing nozzle as in claim 1, wherein said member is made of borosilicate glass.

4. An airless atomizing nozzle as in claim 1, wherein: a) said body includes an inwardly projecting first shoulder in said bore; and b) said member includes a complementary inwardly projecting second shoulder that engages said first shoulder.

5. An airless atomizing nozzle as in claim 1, wherein said pin is secured to said body with adhesive.

6. An airless atomizing nozzle as claim 5, wherein said adhesive is UV curable.

7. An airless atomizing nozzle as in claim 1, wherein said pin is made of stainless steel.

8. An airless atomizing nozzle as in claim 1, wherein said pin is U-shaped.

9. An airless atomizing nozzle as in claim 1, wherein said body includes outside threads for securing to a source of water to be atomized.

10. An airless atomizing nozzle as in claim 1, wherein said body is made of stainless steel.

11. An airless atomizing nozzle as in claim 1, wherein: a) said body includes a lip disposed at the periphery of said bore outlet; b) said member is supported by said lip.

12. An airless atomizing nozzle as in claim 11, wherein said member is secured to said lip by crimping a portion of said bore outlet disposed above said lip toward said orifice member.

13. An airless atomizing nozzle as in claim 11, wherein said member is secured to said lip by adhesive.

14. An airless atomizing nozzle as in claim 13, wherein said adhesive is UV curable.

15. An airless atomizing nozzle, comprising:

a) a tubular body including a bore having an inlet and an outlet;

b) said body including a first face disposed at said outlet;

c) a member including a second face and an orifice secured at said outlet wherein said member is cylindrical including a delivery channel including a tapered inlet and an outlet terminating at said orifice;

d) a pin including a target area spaced from and directly over said delivery channel outlet; and e) said pin is secured to said body with UV curable adhesive.

* * * * *